United States Patent [19]

Glassman

[11] 4,214,597

[45] Jul. 29, 1980

[54] HAIR WAVING METHOD AND DEVICE

[76] Inventor: Geraldine Glassman, 135 E. 50th St., Apt. 6C, New York, N.Y. 10022

[21] Appl. No.: 853,892

[22] Filed: Nov. 22, 1977

[51] Int. Cl.[2] ..... A45D 20/00

[52] U.S. Cl. ..... 132/9; 132/40

[58] Field of Search ..... 132/9, 40, 42, 39

[56] References Cited

U.S. PATENT DOCUMENTS

| | | | |
|---|---|---|---|
| 1,385,797 | 7/1921 | Siegel | 132/40 |
| 1,526,480 | 2/1925 | Krieg | 132/40 X |
| 2,624,350 | 7/1953 | King | 132/41 R |
| 3,265,075 | 8/1966 | Edman et al. | 132/9 |
| 3,586,820 | 6/1971 | Yamanaka | 132/33 R |
| 3,680,565 | 8/1972 | Giles | 132/9 |
| 4,003,389 | 1/1977 | Waite | 132/40 |

*Primary Examiner*—G. E. McNeill

*Attorney, Agent, or Firm*—Robert K. Youtie

[57] ABSTRACT

A hair waving device and method wherein a connector part is provided with a pair of spaced walls extending generally longitudinally of each other from the connector part, the walls having smoothly convex transversely arcuate surfaces of at least 90° arc, which surfaces face generally away from each other, so that a tress of hair may be passed over one smooth surface, then tangentially between the surfaces, and then over the other surface.

10 Claims, 11 Drawing Figures

FIG. 1
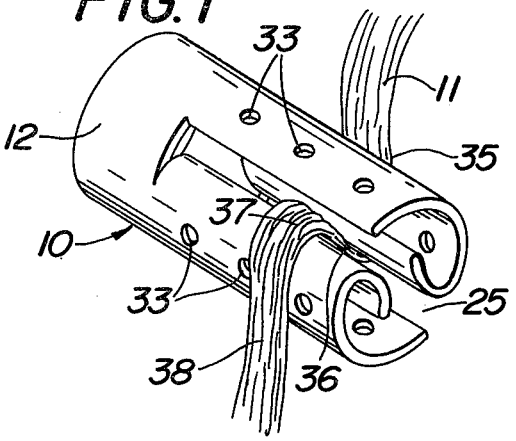
FIG. 2
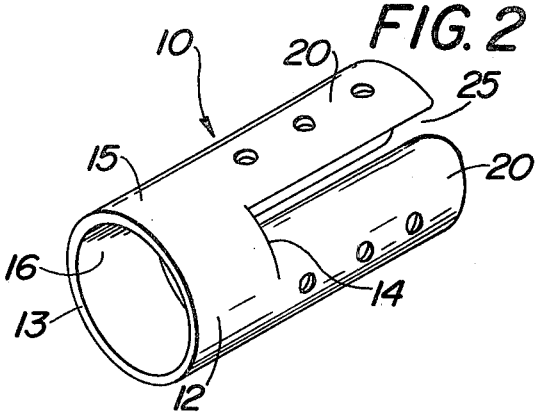
FIG. 3
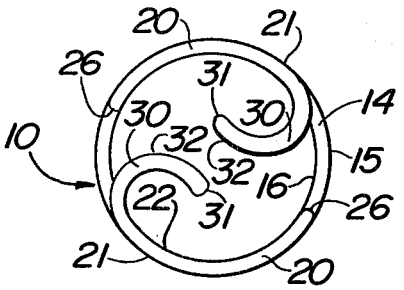
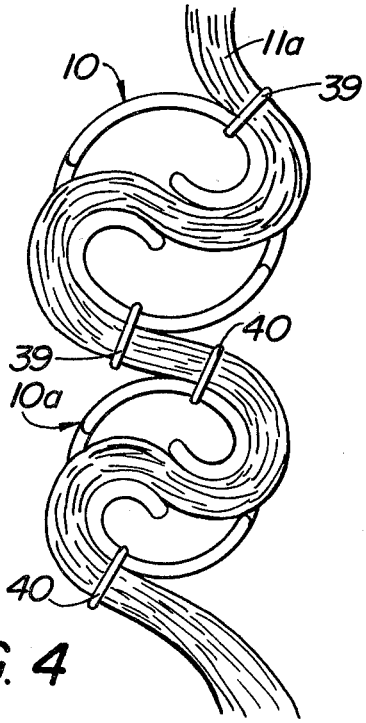
FIG. 4
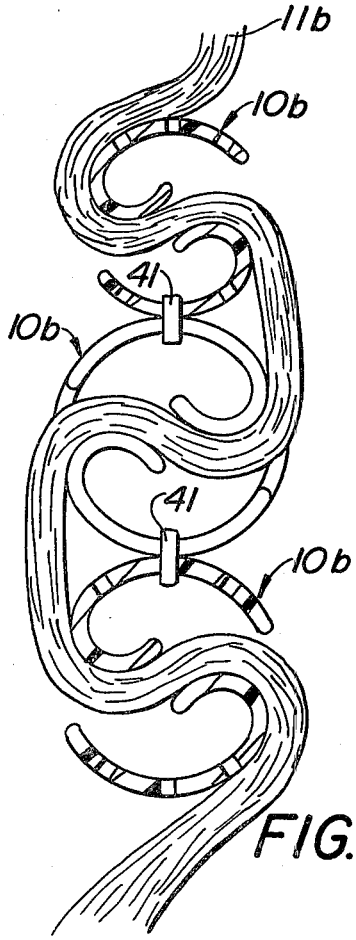
FIG. 5

FIG. 6
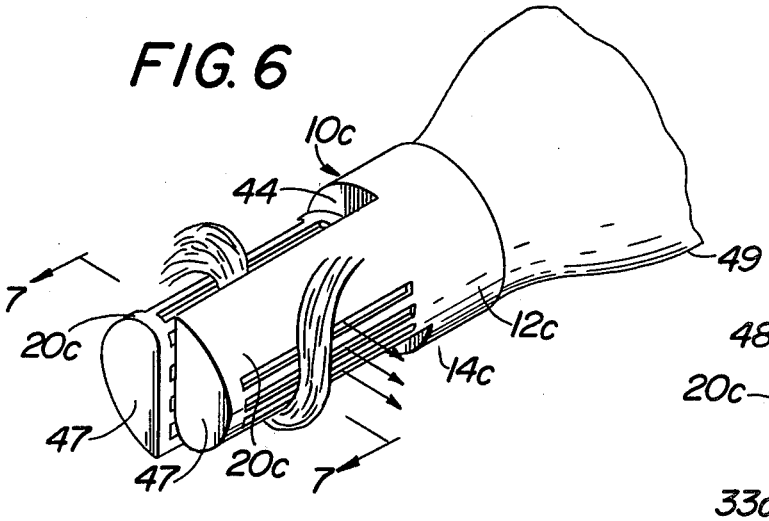
FIG. 7
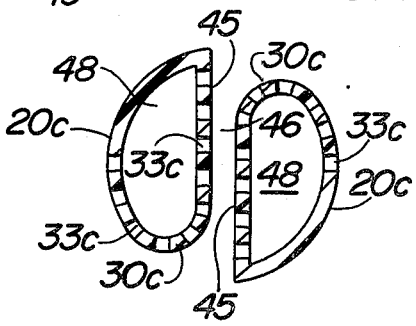
FIG. 9
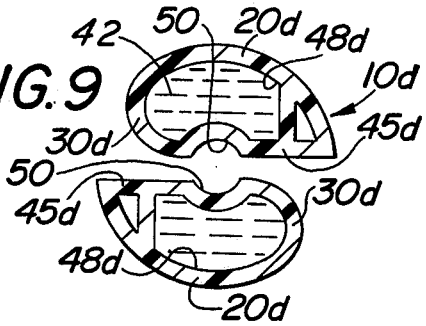
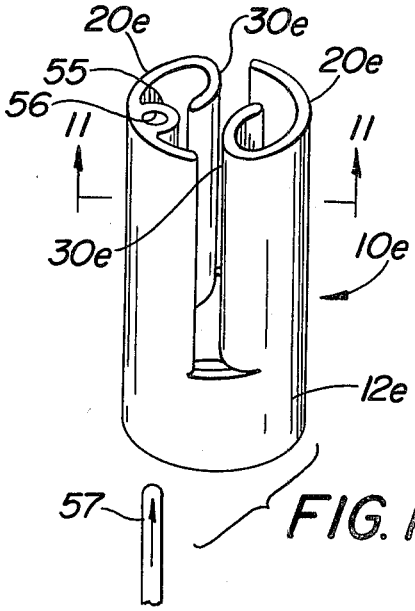
FIG. 10
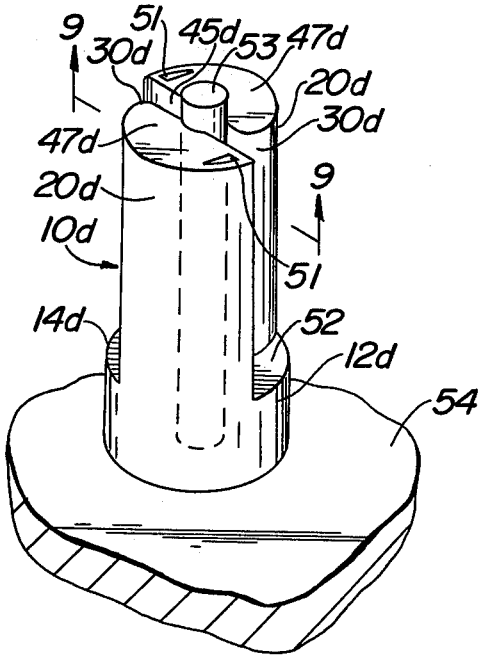
FIG. 8
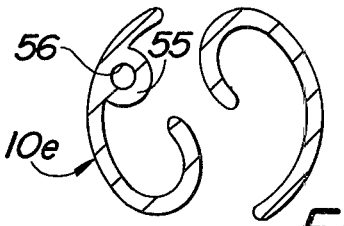
FIG. 11

HAIR WAVING METHOD AND DEVICE

BACKGROUND OF THE INVENTION

While there are, in the prior art, a great number of devices for forming hair into curls, being multiple concentric convolutions, and there are some devices for forming hair into oppositely extending or zig-zag waves, the prior art devices and methods are incapable of producing hair having smoothly flowing waves of selected size, spacing, and the like.

SUMMARY OF THE INVENTION

Accordingly, it is an important object of the present invention to provide a device and method for waving hair which overcomes the above mentioned difficulties, insures smoothly flowing waves without kinks, creases or ridges by training only over smoothly convex arcuate surfaces, permits of wave size variation and selected wave spacing, as desired.

It is a further object of the present invention to provide a wave forming method and apparatus for hair, which assures uniformity of waves, without appreciable variation in wave size, including curvature and width, for maximum body and attractiveness.

It is still another object of the present invention to provide a hair waving method and device of the type described which is extremely simple and easy to use, effecting substantial savings in time while producing considerably improved waving results, and being capable of use by an amateur subject, as well as a professional operator.

It is still another object of the present invention to provide a hair waving device having the advantageous characteristics mentioned in the preceding paragraph, which is uniquely simple in structure, durable and reliable throughout a long useful life, substantially foolproof in operation, and which can be readily adapted for use in conjunction with blow dryers, and heaters of various types.

It is still another object of the present invention to provide a hair waving apparatus wherein a tress of hair is adapted to extend through the apparatus in an S-shaped configuration, and waved in such configuration, without creases or other undesired distortions, to produce a free flowing hair wave of any desired size, curvature, and spacing, which desired hair waving may be accomplished by persons without special training, and without appreciable chance of error, as the waving device substantially completely controls the wave formation.

Other objects of the present invention will become apparent upon reading the following specification and referring to the accompanying drawings, which form a material part of this disclosure.

The invention accordingly consists in the features of construction, combinations and arrangements of parts and method steps, which will be exemplified in the following description, and of which the scope will be indicated by the appended claims.

BRIEF DESCRIPTION OF THE DRAWINGS

FIG. 1 is a perspective view showing a waving device of the present invention in operative waving condition with a tress of hair.

FIG. 2 is a perspective view showing the waving device of FIG. 3, but from the left of FIG. 1.

FIG. 3 is an end view of the device of FIG. 2, taken from the right-hand end.

FIG. 4 is an end view showing a pair of hair waving devices of the present invention in operative association with a single tress of hair.

FIG. 5 is a sectional view showing a plurality of hair waving devices of the present invention in operative association with a tress of hair.

FIG. 6 is a perspective view showing a slightly modified embodiment of hair waving device in operative association with a blower and a tress of hair.

FIG. 7 is a transverse sectional view taken generally along the line 7—7 of FIG. 6.

FIG. 8 is a top perspective view showing another embodiment of hair waving device of the present invention, for use with heating pins.

FIG. 9 is a sectional view taken generally along the line 9—9 of FIG. 8.

FIG. 10 is a top perspective view showing another slightly modified embodiment of hair waving device of the present invention adapted for use with a hair curling heater.

FIG. 11 is a sectional view taken generally along the line 11—11 of FIG. 10.

DESCRIPTION OF THE PREFERRED EMBODIMENTS

Referring now more particularly to the drawings, and specifically to FIGS. 1–3 thereof, a hair waving device is there generally designated 10, and shown in operative association with a hair tress 11 in FIG. 1.

The hair waving device 10 may include a handle or connector part 12 at one end, which may be of a centrally open configuration, say of an annular ring or cylindrical tube shape, as illustrated.

More specifically, the generally cylindrical part 12 may include a generally circular outer end edge 13, and a similarly generally circular inner end edge 14. Extending between the circular end edges 13 and 14, the connector includes an external generally cylindrical surface 15, and an internal generally cylindrical surface 16.

Extending from diametrically opposed or distal regions of connector edge 14, generally longitudinally of the cylindrical axis of connector 12 and with respect to each other, are a pair of arcuate walls 20. That is, the walls 20 extend generally longitudinally of each other from the end edge 14, and may be transversely arcuate and generally concentric with the axis of connector 12. Further, the convex external surface 21 of each wall 20 may be a flush extension of the external connector surface 15, while the internal transversely arcuate concave surface 22 of each wall 20 may be a flush extension of the internal connector surface 16.

Hence, the longitudinally extending walls 20 may be substantially identical and diametrically opposed cylindrical wall segments, each of at least approximately an angular extent of 90°. The walls 20 are each of considerably less angular extent than 180°, so as to define therebetween diametrically opposed spaces or openings, as at 25. That is, the openings 25 each extends from connector edge 14, longitudinally of and beyond the outer ends of the walls 20.

Each arcuate segment or wall 20 terminates at one side in a longitudinally extending edge 26, which edges are generally diametrically opposed from each other. The other side of each wall 20 is provided with a side extension or auxiliary wall 30 which is smoothly arcuate and reversely bent into the space between walls 20, so as to be aligned with the central opening of connector part 12. More specifically, each side extension 30 merges smoothly with one side of a respective wall 20, remote from the side edge 26, and is smoothly arcuate having a radius of curvature less than that of the associated segment wall 20. Thus, each side extension wall 30 is reversely bent with respect to its adjacent wall 20, being smoothly convergent with one edge of the latter, and may terminate in a longitudinal edge portion 31 extending generally radially outwardly toward the internal surface 22 of the associated wall 20. By this reversely bent convexly smooth arcuate configuration of each side extension 30, the side extensions have their transversely arcuate convex surfaces 32 extending into facing spaced relation with respect to each other, on opposite sides of the longitudinal axis of the cylindrical segment walls 21.

In addition, it will be observed that the walls 20 may be pervious to a drying medium, such as heated air or the like, as by perforations or holes 33.

As shown in FIG. 1, the tress of hair 11 is passed over the convexly curved outer surface 21 of one wall 20, as at 35, thence through one side opening 25 over the convexly curved surface of adjacent side extension 30, and leaving the latter generally tangent thereto for passage between the pair of side extensions 30, as at 36. From the space between side extensions 30, the tress continues 37, over the smoothly convexly arcuate surface of the other side extension 30, and thereabout onto and across the convexly curved external surface 21 of the other wall 20, as at 38. Of course, the hair tress 11 may be of any selected size or hair quantity, and spread as desired along the convex surfaces, being shown herein for purposes of illustration only and without limiting intent. Further, suitable hair pins or clips may be applied to secure the tress 11 in position with respect to the waving device 10, and hold the latter into position on the wearer's head.

It will now be appreciated that the hair waving device serves to constrain the hair tress 11 to a generally S-shaped configuration, which is entirely smoothly arcuate without possibility of the formation of creases, kinks, or the like. While the pair of walls 20 and their respectively associated side extensions 30 have been shown as substantially equal and identical in FIGS. 1–3, it is appreciated that one may be larger than the other, if desired, without departing from the method and structure for extending a hair tress in an S-shaped configuration. Also, it is appreciated that any selected number of hair waving devices 10 may be utilized, as desired, even on a single hair tress, and may be located closely adjacent to each other for closely continuously repeating waves, or spaced apart for the formation of spaced waves.

By way of example, a pair of hair waving devices 10 and **10*a* are shown in FIG. 4, the latter being substantially identical to but smaller than the former, so as to produce waves of different size, if this is desired. That is, the tress 11*a* passes in its S-shaped configuration about and through wave forming device 10, being secured thereto by clips 39, and thence passes immediately through the smaller wave forming device 10*a*, for securement to the latter by additional clips 40**. In this manner closely adjacent waves are formed one above the other, with the lower wave smaller than the upper.

Another variation in practice of the present invention is shown in FIG. 5, wherein a plurality of wave forming devices **10 *b* are arranged in closely adjacent relation with each other, and may be secured directly to each other by suitable securing means or clips 41. Thus, in the illustrated variation of FIG. 5, the waving devices 10*b* are arranged in closely adjacent superposed relation with cylindrical wall segments generally tangent to each other. In such arrangement the hair tress 11*b* does not pass in the space between adjacent hair waving devices 10*b*, but in one direction through one hair waving device, and thence in the opposite direction through the adjacent hair waving device, and further in this manner. In order to accommodate the tress in this manner, the hair waving devices are alternately inverted, as illustrated by the sectional showings of the upper and lower hair waving devices 10*b***.

Of course, many different variations may be employed in combinations and arrangements of various sizes and shapes of hair waving devices of the instant invention.

Considering now FIGS. 6 and 7, a hair waving device is there generally designated **10*c*, including a generally cylindrical connector part 12*c* and a pair of opposed walls 20*c* extending longitudinally with respect to each other from opposed regions of the connector part 20*c*. The opposed walls 20*c* may be cylindrical segments, and provided on opposite sides with inturned, reversely bent convexly smooth side extensions 30*c*. In addition, a partition, wall or closure 45 extends from each side extension 30 generally diametrically to the opposite side of the same wall 20*c*, to leave a generally diametral path 46 between the facing spaced closure walls 45**.

Remote from the connector **12*c*, a pair of end members or walls 47 are provided extending in closing relation across the distal end of each side wall 20*c* and its adjacent side extension 30*c* and closure 45. Fluid passage openings 33*c* are provided in the walls 20*c* and closures 45. Additionally, a generally S-shaped wall 44 extends between the edge 14*c* of connector 12*c* and the adjacent edges of side extensions 30*c* and closures 45. Hence, the interior space or chamber 48 within each wall 20, side extension 30, closure 45 and end member 47 communicates with the interior of connector 12*c*, which may be connected, as by friction fit or other suitable connection means to the blower dryer 49**.

It will now be appreciated that the hair waving device **10*c* of the instant invention may be incorporated with the blower dryer 49** to achieve the advantageous results of the instant invention in combination with the drying effects of the blower.

In FIGS. 8 and 9 are shown another slightly modified embodiment, wherein a hair waving device of the present invention is generally designated **10*d*, and may include a generally cylindrical connector 12*d*, from opposite sides of which extend generally cylindrical segmental walls 20*d*, each being provided with a reversely bent convexly smooth side extension 30*d* and a closure wall 45*d* extending between each side extension and the opposite side of the associated cylindrical segment. Further, the closures 45*d* are in facing spaced relation with each other and formed on their facing sides with complementary, longitudinally extending, generally semi-cylindrical recesses 50, best seen in FIG. 9**.

Also, the waving device **10*d* may be provided on its outer ends with end members or walls 47*d* which may be provided with blind holes or pockets 51**, for a purpose appearing presently.

The inner ends of walls **20*d*, side extensions 30*d* and closures 45*d* may be closed by an additional closure wall 52, which extends entirely across the end edge 14***d* of cylindrical connector part 12*d*.

Thus, there are defined closed chambers 48*d* bounded within the walls 20*d*, side extensions 30*d*, closures 45*d*, outer end walls 47*d* and inner end wall 52. These chambers may contain a heat transfer medium or fluid 42.

The hair waving device 10*d* of FIGS. 8 and 9 may be employed in association with a heating pin 53 upstanding from a base 54, the heating pin extending conformably through the space between facing recesses 50 and transmitting heat through closures 45*d* to the medium 42. When hot, the hair waving device 10*d* may be removed and applied to the hair, in the same manner as described hereinbefore, and holding clips employed and inserted into recesses or pockets 51. In this manner, heating, drying and setting of the hair is achieved while forming the desired wave.

A further embodiment of the present invention is shown in FIGS. 10 and 11 wherein a hair waving device 10*e* is generally similar to the device 10, including a generally cylindrical connector 12*e*, longitudinally extending generally cylindrical segment walls 20*e* projecting from spaced sides of the connector, and the side extensions 30*e*, all generally similar to the first described embodiment. However, at least one of the walls 20*e* may be provided with an internal boss 55, extending longitudinally along and on the inner surface of the wall 20*e*, and having an internal through hole or passageway 56. The passageway 56 is configured to receive a heating element 57 inserted into the boss 55, so as to heat the waving device 10*e* and thereby impart heat to hair being waved. The heating element 57 may be of the type generally employed as a curling iron, or other suitable heating element, and may be applied to the waving device 10*e* either before or during the waving procedure.

From the foregoing, it is seen that the instant invention provides a method and apparatus for waving hair which are extremely simple, highly effective to produce smoothly flowing and attractive waves, and otherwise fully accomplish their intended objects.

Although the present invention has been described in some detail by way of illustration and example for purposes of clarity of understanding, it is understood that certain changes and modifications may be made within the spirit of the invention.

What is claimed is:

1. A hair waving device comprising a connector part, a pair of spaced walls extending longitudinally of each other from one side of said connector part, said walls having their oppositely outwardly facing surfaces smoothly transversely convex, and a reversely bent convexly smooth side extension on each of said walls extending into the space between said walls and into facing spaced relation with each other, said side extensions merging smoothly with respective walls, whereby a tress of hair is adapted to extend in an S-shaped configuration along the outwardly facing surface of one wall, then along the adjacent side extension into the space between said side extensions and along the other side extension and thence along the outwardly facing surface of the other wall.

2. A hair waving device according to claim 1, said connector part comprising a generally annular member, said walls extending from opposite portions of said annular member.

3. A hair waving device according to claim 2, said annular member being generally circular, and said outwardly facing wall surfaces being generally circular and substantially flush with said annular member.

4. A hair waving device according to claim 3, said side extension extending into alignment with the central opening of said annular member.

5. A hair waving device according to claim 3, said walls being perforated for free passage of drying medium.

6. A hair waving device according to claim 1, said connector part being generally tubular for connection to a source of drying fluid, a closure extending between each extension and the remote side of the associated wall and combining therewith to define a chamber, and an end member across the outer end of each of said chambers, therebeing openings in certain of said walls, extensions and closures for passing drying medium.

7. A hair waving device according to claim 1, in combination with a closure extending between each extension and the remote side of the associated wall and combining therewith to define a chamber, an end member across the outer end of each of said chambers, and heat transfer medium captured in said chamber for being heated and transferring heat to hair.

8. A hair waving device according to claim 7, said closures being formed with complementary facing longitudinally extending recesses combining to define a socket for receiving a heating element.

9. A hair waving device according to claim 7, said end member having an opening for removably receiving a hair clip.

10. A hair waving device according to claim 1, in combination with a socket formed in one of said walls for removably receiving a heating element to heat the device.

* * * * *